United States Patent [19]

Kriechbaum et al.

[11] 4,227,848

[45] Oct. 14, 1980

[54] CAN CHANGING DEVICE

[75] Inventors: Kurt Kriechbaum, Ebersbach; Hans Kienhofer, Rechberghausen; Rin J. Picht, Hochdorf, all of Fed. Rep. of Germany

[73] Assignee: Zinser Textilmaschinen GmbH, Ebersbach, Fed. Rep. of Germany

[21] Appl. No.: 3,313

[22] Filed: Jan. 12, 1979

Related U.S. Application Data

[63] Continuation-in-part of Ser. No. 728,063, Sep. 30, 1976, abandoned.

[30] Foreign Application Priority Data

Sep. 30, 1975 [DE] Fed. Rep. of Germany ..... 2543621

[51] Int. Cl.[3] ..... B65G 67/00

[52] U.S. Cl. ..... 414/395; 19/159 A; 414/398; 414/574

[58] Field of Search ..... 414/344, 398, 68, 110, 414/395, 574; 198/345, 347, 485; 242/82-83, 79; 19/159 A

[56] References Cited

U.S. PATENT DOCUMENTS

| | | | |
|---|---|---|---|
| 3,698,041 | 10/1972 | Hertzsch | 19/159 A |
| 3,808,641 | 5/1974 | Schneider | 19/159 A |

*Primary Examiner*—Stephen G. Kunin
*Assistant Examiner*—Lawrence E. Williams
*Attorney, Agent, or Firm*—Edwin E. Greigg

[57] ABSTRACT

There is provided herein an automatic can changing device for spinning preparation machines such as for drawing frames, carding or combing machines in which a stationary conveyor is provided that is associated with a fiber lap delivery station, with mechanism for removing empty cans from the conveyor and presenting them to the fiber lap delivery station for the filling operation and thereafter removing these filled cans from the fiber lap delivery station and depositing them in an intermediate station preparatory for introduction to movable carriages also being shown.

13 Claims, 3 Drawing Figures

CAN CHANGING DEVICE

This is a continuation-in-part of U.S. Patent Application Ser. No. 728,063, filed Sept. 30, 1976, entitled, "A Can Changing Device", now abandoned.

BACKGROUND OF THE INVENTION

The present invention relates to an automatic can changing device for spinning preparation machines, preferable for drawing frames and carding and combing machines, comprising a plurality of conveyor carriages for transporting full and empty cans. The machines preferably comprise at least one fiber lap delivery station for fiber laps which are to be fed into cans and the empty cans are adapted to be moved automatically from the conveyor carriage to a corresponding fiber lap delivery station and the filled cans are also adapted to be moved automatically onto the conveyor carriages.

In the case of a known device of this type (German AS 1 266 672) the empty cans are supplied to the fiber lap delivery station in one direction and the filled cans are removed in the same direction on the other side. Moreover, each carriage is designed to hold two rows of cans: the cans contained in one row of a carriage holding empty cans are first pushed down in succession from the carriage according to the can changing rhythm. The carriage is then moved at right angles to the ejection direction and the cans in the other row are then successively pushed down from the carriage. Likewise, when the filled cans are being loaded onto the carriage, one row of cans is first pushed onto the carriage. The carriage is then moved at right angles to its starting position and the cans in the other row are successively pushed onto the carriage. This system necessitates, among other things, complicated drive mechanisms for the carriages. The empty cans must also first be pushed under the drawing frame connected in series with the fiber lap delivery station and, as a result, the spinning preparation machines must be specially constructed. Tracks for the carriages also extend along three sides of the spinning preparation machines.

OBJECT AND SUMMARY OF THE INVENTION

The object of the invention is thus to produce a device of the type described initially which has a simple structure, does not necessitate special constructional features of the spinning machines and wherein the carriage has a large can capacity and does not have to be displaced during the loading and unloading operations.

According to the invention, in a device of the type described initially, a stationary transit station for empty cans is located upstream of each fiber lap delivery station. This stationary transit station is also a transit station for filled cans to be deposited on a carriage and it is also a station in a stationary conveyor system provided with at least one unloading station and one loading station. A carriage containing empty cans is designed to be drawn up to the unloading station and automatically unloaded and an empty carriage is designed to be drawn up to the loading station and automatically loaded with filled cans.

As the empty and filled cans pass through a common transit station before reaching the fiber lap delivery station, the device according to the invention is suitable for all types of spinning machines for producing and/or drawing fiber laps and, in particular, for all types of drawing frames, carding and combing machines as the empty cans are always supplied to the fiber lap delivery station from the transit station and the filled cans are always returned to the transit station. As a result, the can changing operation only takes place on one side of the machine. It is therefore unnecessary for the cans to be moved under passages for supplying the fiber lap to the fiber lap delivery station. In this respect also, full constructional freedom is maintained with regard to the design of the particular spinning preparation machine. Moreover, all the can changing operations including loading and unloading of the carriage take place fully automatically and rapidly at the unloading and loading station or stations.

The term spinning preparation machines refers to all types of machines which comprise at least one fiber lap delivery station at which the fiber lap is fed into a can, preferably from above. However, according to the invention, the fiber lap can also be fed in from below.

The invention is also particularly suited to the use of carriages which, after being loaded with filled cans, are pushed under the spinning mechanisms of open end spinning machines and the cans are then advanced while the fiber laps are being drawn out. The thus emptied cans are then returned by means of the same carriage to a spinning preparation machine. The displacement of the carriage from the spinning preparation machine to the open end spinning machine or other pre-spinning or spinning machine, such as a flyer, a drawing machine, combing machine, etc., can generally be advantageously accomplished manually. However, tracks can also be provided for this purpose. The carriages will be automatically displaced on these tracks by means of draw chains or the like and may possibly be equipped with their own drive system. The cans can also be changed manually at the can changing device of the particular spinning preparation machine. Alternatively, this can be effected by automatic conveying means. A carriage which was unloaded at the unloading station is preferably then conveyed to the loading station and loaded with filled cans.

Spinning preparation devices which feed fiber laps into cans generally comprise one or two fiber lap delivery stations. The device according to the invention is perfectly suitable for either case. However, it can also be used with spinning preparation machines having more than two fiber lap delivery stations, for example, four delivery points.

It is also preferable for each carriage to hold two rows of cans each containing four cans. This is particularly advantageous when the filled cans loaded onto a carriage at the loading station are unloaded at an open-end spinning machine.

The can changing device according to the invention is uncomplicated and is therefore reliable in operation and simple to construct. It also has other advantages.

The invention will be described in more detail hereinafter in reference to various embodiments thereof which are represented in the accompanying drawings and to variants thereof which are not represented in the drawings. Numerous other embodiments of the invention are obviously also possible.

DESCRIPTION OF THE PREFERRED EMBODIMENT

Figure 1:
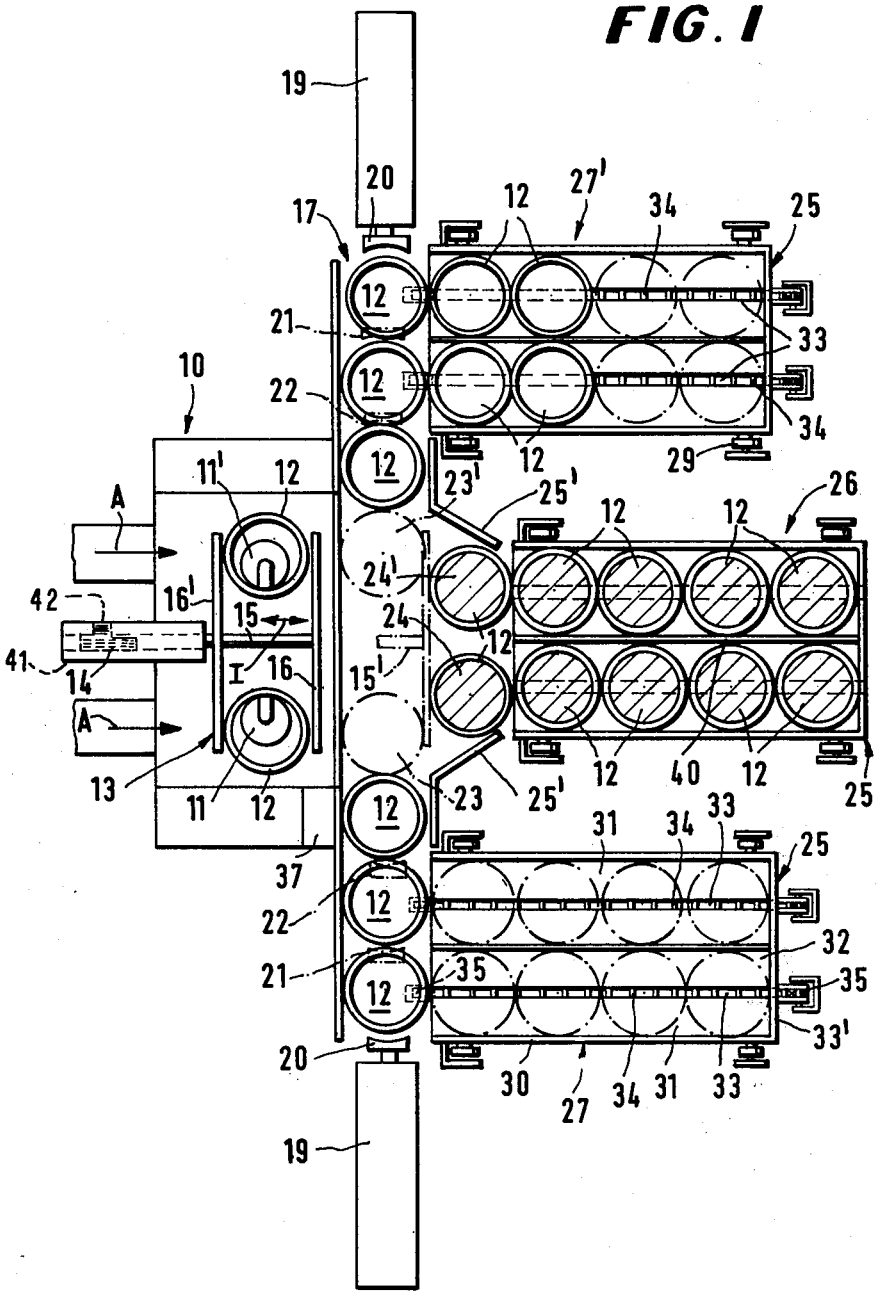
FIG. 1 is a diagrammatic plan view of a can changing device constructed in accordance with the invention.

Referring now to FIG. 1, there is shown a diagrammatic sectional view of a spinning preparation machine 10 comprising two fiber lap delivery stations 11, 11', to which fiber laps formed by the drawing frame of the machine 10 and extending in the direction of the arrow A, are supplied. Each fiber lap delivery station 11, 11' feeds one fiber lap from above into a can 12 in conventional spiral windings by means to a coiler plate. A slider 13 and associated drive means 14 are mounted on this spinning preparation machine 10 which can consist, for example, of a drawing frame. The slider 13 comprises a shaft 15, on which two straight rods 16, 16' are mounted, as shown, by way of their median portions at right angles to the axis of rotation of the shaft 15 so that each rod 16, 16' forms a double arm. The shaft 15 is displaceable both horizontally in the direction of its axis of rotation as indicated by the double arrow I between the fully extended position 15' represented by the line of dots and dashes and the solid line portion of FIG. 1 and it is also angularly pivotable by 90° about its axis of rotation. In the illustrated embodiment, rotation of the shaft 15 to pivot the arms 16, 16' may be accomplished in any suitable manner such as by the provision of a splined portion 41 on the shaft 15 engageable with a pinion 42 driven in the desired direction by any suitable driving means such as a motor 42. In the drawing, filled cans 12 have been cross-hatched and the empty cans are unshaded. The cans located at the delivery stations 11, 11' are in the course of being filled and are unshaded.

A straight conveyor path 17 extends in front of the front side of the machine 10 and is parallel to the same such that the delivery stations 11, 11' are equidistant from the conveyor path 17. A drive device 19 is disposed at each of the two longitudinal ends of the conveyor path 17. Each drive device 19 comprises a plunger 20 which is adapted to be displaced in a straight line horizontally between the solid line position represented and the two positions 21, 22 represented by the lines of dots and dashes. The plungers 20 are designed to supply empty cans 12 to the respective transit stations 23, 23' for empty and filled cans 12. These two pneumatic devices 19 can be operated in synchronism. In the embodiment of FIG. 1, stationary intermediate stations 24, 24' for a filled can 12 is provided on the side of each of the two transit stations 23, 23' remote from the fiber lap delivery stations 11, 11' respectively. Vertical, stationary guide surfaces 25', which are obliquely inclined with respect to the longitudinal direction of the conveyor path lead to the intermediate stations 24, 24'. As a result, filled cans from the transit stations 23, 23' can be conveyed to the positions represented by solid lines at the stationary intermediate stations 24, 24'. The intermediate stations 24, 24' are aligned with the two carriages 25 each designed to receive a row of cans containing four cans. The middle of the three carriages 25 is located at a loading station 26 in which it will be loaded with filled cans 12 and the carriages 25 which are arranged parallel to and spaced apart from the carriage at the loading station 26 on both sides are each disposed at an unloading station 27, 27' at which the empty cans 12 disposed thereon are automatically moved onto the conveyor path 17 at right angles to its longitudinal direction.

The carriages are advantageously "deep loaders", that is, their bottom surface, which is used to carry the cans, is only a short distance from the ground. The conveyor path 17 is at the level of the bottom faces of the carriages located at the loading and unloading stations 26, 27, 27'. The four wheels of each carriage 25 are preferably pivotably hinged (not shown) so that the carriage 25 can be moved in any direction without difficulty, even at right angles to or at an incline with respect to its longitudinal axis.

In the embodiment of FIG. 1, each carriage 25 has a vertical frame 30 extending along its two longitudinal sides and its rear side. Three base panels 31, 32 are rigidly connected to the frame 30, namely, two base panels 31 on the two longitudinal sides of the frame 30 and a base panel 32 disposed between the two; the middle base panel 32 being separated from the two outer base panels 31 by a continuous longitudinal slot 33. Each longitudinal slot 33 also extends vertically for a short distance into the rear side 33' of the frame 30 so that one or more engaging elements disposed on the conveying chains 34 provided at the unloading stations 27, 27' can pass through the longitudinal slots 33 in the base of the carriages 25 located at the unloading stations 27, 27', so as to extend a short distance beyond the carriage wall and move the empty cans 12 arranged on the carriages 25 located at the unloading stations 27, 27' onto the conveyor path 17. Accordingly, each unloading station 27, 27' is equipped with two such parallel endless conveying chains 34 which extend at right angles to the lengthwise direction of the conveyor path 17 beneath the base of the carriages 25, 26 located at the unloading stations 27, 27'. Each of the conveying chains 34 is deflected by means of two chain wheels 35 which have horizontal axes of rotation; one of the chain wheels 35 of each conveying chain being driven by a motor (not shown). No conveying chains 34 are provided at the single loading station 26, as the filled cans are pushed onto the carriage 25 standing at the loading station 26 by means of the slider 13 in a manner which will be described in more detail hereinafter.

An automatic control device 37 is provided. Each time a can change is required at the two delivery stations 11, 11', this device 37 becomes active and is programmed to control the drive means 14 for the slider 13, the drive means 19 for the two plungers 20 and the drive means for the conveying chains 34 in a predetermined manner. The machine 10 comprises a counter for determining the length of the fiber lap fed into the cans located at the delivery stations. Upon reaching a predetermined value, the fiber lap ceases to be delivered and a can changing operation is automatically released. The control device controls this operation in a manner which will be described hereinafter; the control of empty cans supplied to the transit stations 23, 23' being carried out according to two alternately implemented programs, as will be described hereinafter.

To achieve the filled state of the three carriages 25 as shown in FIG. 1, in a preceding can changing operation, the carriage 25 standing at the loading station 26 was fully loaded so that it now holds eight full cans 12. The carriage 25 standing at the unloading station 27' has been partially unloaded so that it now holds four empty cans 12 and the carriage 25 standing at the unloading station 27 has been previously completely emptied. It should be noted that in FIG. 1, all the can positions, at which there are presently no cans, have been represented by circles marked by dots and dashes. In the represented state, fiber laps are being fed into the two cans 12 at the fiber lap delivery stations 11, 11'. Before the next can changing operation takes place, the carriage 25 standing at the loading station 26 is removed by an operator because it is full. The operator then moves the empty carriage standing at unloading station 27 to the loading station 26 and guides it into the position determined by stops and guide bars. This position can possibly also be maintained by means of a coupling or other securing means. The carriage may also possibly be equipped with brakes which hold it in the requisite position. The full carriage 25, which was previously removed, is now moved, for example, manually to an open-end spinning machine or other machine in the following processing stage. Another carriage containing eight empty cans 12 is now manually moved to the empty unloading station 27 and guided into the requisite position which is again determined by stops and guide bars. Other suitable devices can be used in place of the stops and guide bars for holding the carriage in the correct position at the unloading stations 27, 27'.

A carriage 25 containing eight empty cans is thus now located at the unloading station 27 and an empty carriage is located at the loading station 26. The carriage disposed at the unloading station 27' is still the same and contains four empty cans 12: two cans being disposed in each of the two rows in the carriage.

As soon as the next can changing operation is necessary and the control device 37 has been activated accordingly, it controls the following can changing operation. The slider 13 is first moved horizontally forward by the drive means 14 as indicated by the double arrow I from the position represented by the solid lines into the position in which the filled cans, which are carried by the arms 16, 16' located in the two transit stations 23, 23'.

The leading arm 16 is then in the position represented by the mixed line of dots and dashes. The double arms 16, 16', are now pivoted by 90° about the axis of rotation of the shaft 15 by the pinion 42 and then the slider 13 is returned to its retracted axial starting position, without taking with it the full cans located at the transit stations 23, 23'.

The double arms 16, 16' are then pivoted back into the horizontal position by the pinion 42 and the slider 13 begins another forward stroke so that the leading double arm 16 now moves the two full cans 12 located at the transit stations 23, 23' simultaneously to the intermediate stations 24, 24' and, in the course thereof, pushes the two full cans 12 hitherto located at these intermediate stations 24, 24' simultaneously onto the empty carriage 25 at the loading station 26 such that this carriage 25 now has a full can 12 at its front open end in each of its rows separated from one another by a vertical guide bar 40.

In this extended position of the slider 13, its two double arms 16, 16' are located in positions on each side of the transit stations 23, 23' in which an empty can can be pushed along the conveyor path 17 between the double arms 16, 16' on both sides. This is effected by the synchronous extension of the plungers 20 into the positions 21 represented by the broken lines. Accordingly, the two rows of empty cans located on the conveyor path are pushed until the front two empty cans 12 in each of these rows are located at the two transit stations 23, 23' in the forks formed by the double arms 16, 16' of the slider 13. The slider 13 is now returned to its position represented by the solid line by the drive means 14 and in so doing, it pushes the two empty cans 12 located in its forks beneath the fiber lap delivery stations 11, 11' and the machine is now actuated to feed the fiber laps into these empty cans. The can interchanging mechanism remains disconnected until these two empty cans 12 have been filled and a fresh can changing operation is then released.

This operation proceeds in a similar manner to the above-described can changing operation with the exception that the two plungers 20 for pushing the two rows of empty cans located on the conveyor path 17—each of these rows now containing two empty cans 12—are moved from the positions 21 to the positions 22 and are then returned into their maximum position with respect to the solid line position of FIG. 1. Two empty cans are then simultaneously moved onto the conveyor path 17 from each carriage 25 at the two unloading stations 27, 27', in the same manner which will be described hereinafter. The full cans which are moved during this can changing operation to the intermediate stations 24, 24' push the four full cans disposed in front of them such that four full cans are now located on the carriage 25 standing at the loading station 26.

After the two plungers 20 have pushed the empty cans to the transit stations 23, 23', from which they were conveyed by the slider 13 beneath the delivery stations 11, 11', the plungers 20 return to their solid line starting positions and the empty cans 12 located on each of the carriages 25 at the unloading stations 27, 27' are pushed until the leading two cans 12 are moved onto the conveyor path 17. This is achieved by means of the four conveying chains 34 and the engaging members disposed thereon. These engaging members engage vertically from below behind the rearmost cans in the two rows of cans in each carriage 25. All the conveying chains 34 can be operated synchronously and are so controlled that they advance the rows of cans located on the two carriages each time by one can spacing. As a result, two cans from each carriage are simultaneously moved onto the conveyor path 17. The solid line can state represented in FIG. 1 is again engaged on the conveyor path 17.

There are now two empty cans 12 located on the carriage 25 at the unloading station 17' and six empty cans 12 on the carriage 25 at the other unloading station 27. During the following can changing operation, the first described can changing operation is repeated in which the conveyor chains 34 are not displaced but only the plungers 20 are moved from the solid line positions by one can spacing into the positions 21. Accordingly, the conveyor chains 34 are only caused to simultaneously move two empty cans from the particular carriage 25 onto the conveyor path 17 in the course of every alternate can changing operation. On the other hand, a can is pushed into each row on the carriage 25 in the loading station 26 during each can changing operation such that this carriage is loaded twice as fast as the other two carriages.

After two further can changing operations, the carriage 25 at the loading station 26 contains eight full cans and the carriage 25 at the unloading station 27' is completely empty and the latter carriage 25 is exchanged for the full carriage 25, i.e., is moved to the loading station 26.

Figure 2:
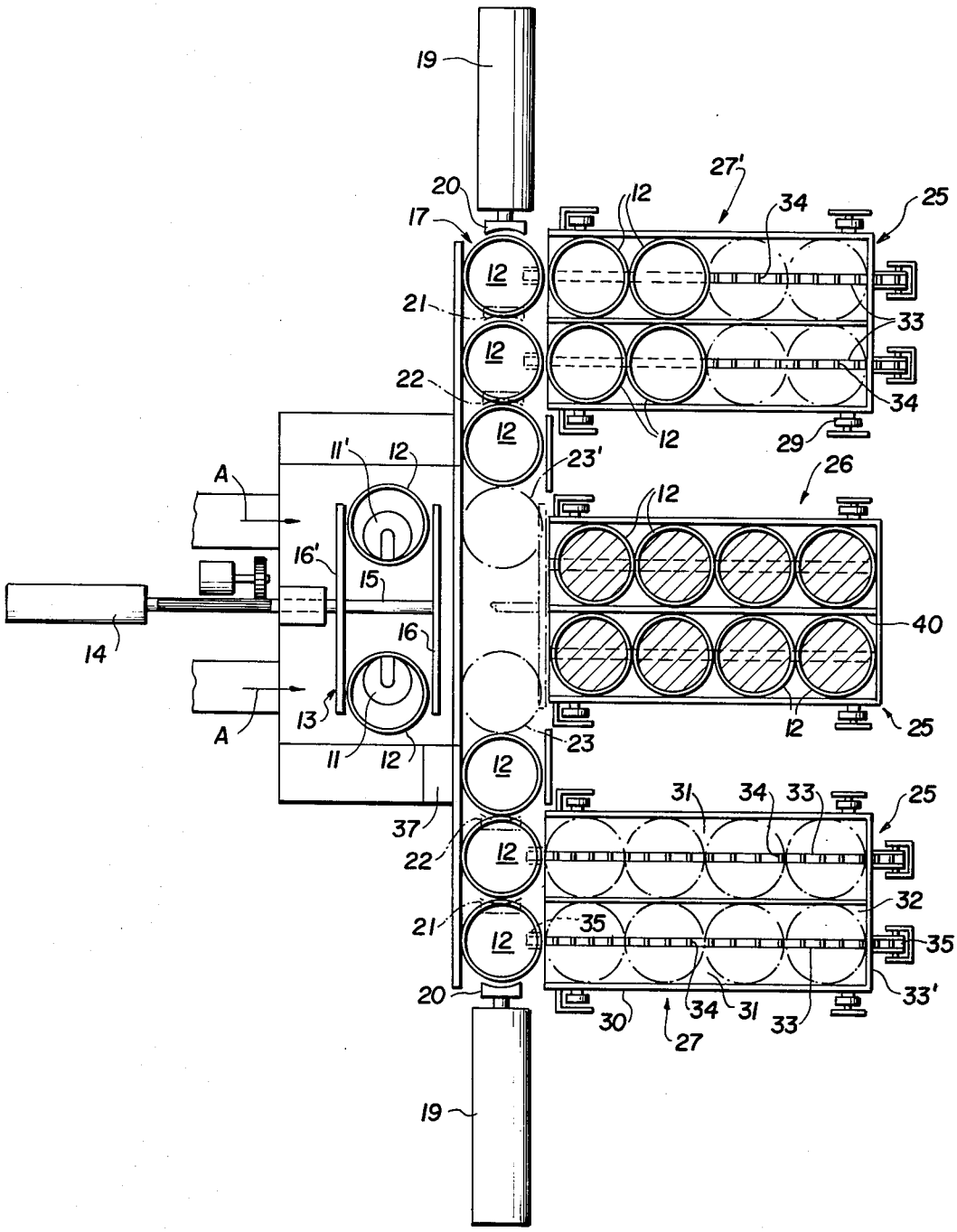
FIG. 2 is a view similar to FIG. 1 of another embodiment of the invention.

Referring now to FIG. 2, there is shown another embodiment of the invention wherein like numerals are used to identify like parts. In the embodiment of FIG. 2, the intermediate stations 24, 24' as well as the vertical, stationary guide surfaces 25' are omitted so that the front open end of the carriage 25 at the loading station 26 is moved up to the conveyor path 17 so as to open directly into the path. With this arrangement, the filled cans 12 can be moved directly by the slider 13 from the transit station 23, 23' into the carriage 25 without passing through an intermediate station.

Figure 3:
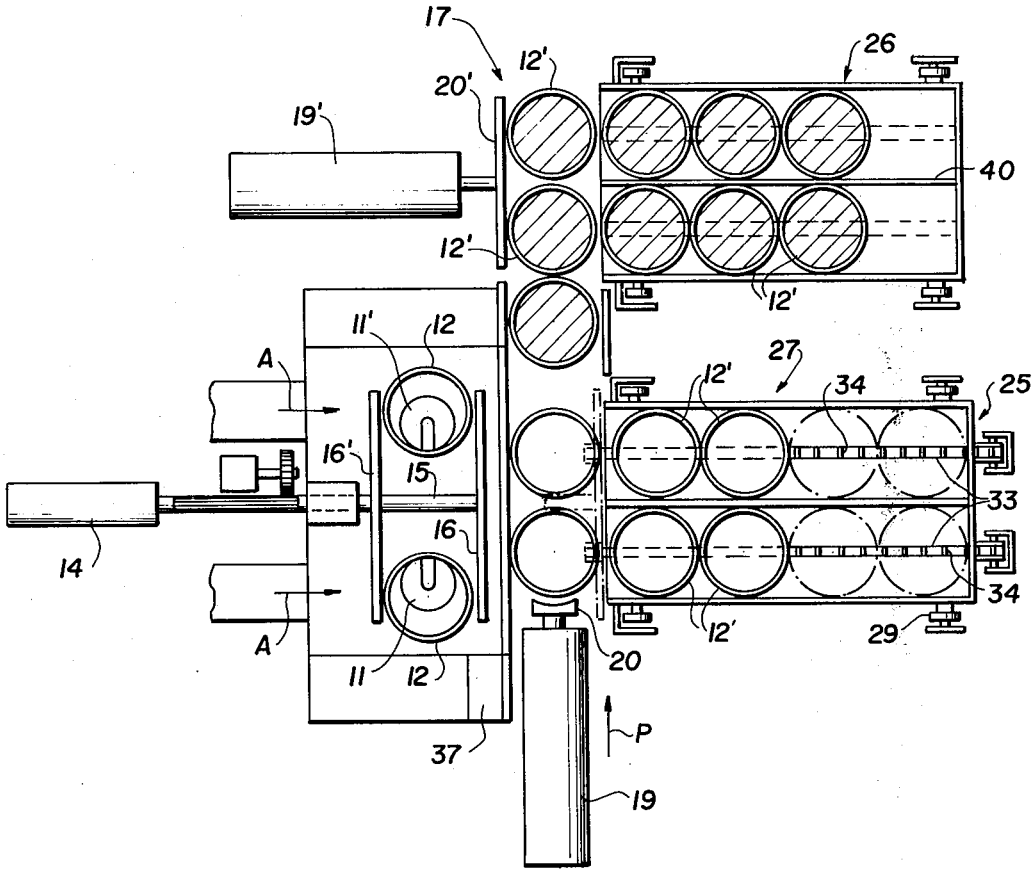
FIG. 3 is a view similar to FIG. 1 of still another embodiment of the invention.

Referring now to FIG. 3, there is shown still another embodiment of the invention wherein like numerals are used to identify like parts. In the embodiment of FIG. 3, only one unloading station 27 is provided, it being understood that, if desired, two of such unloading stations can be provided. Also, as in the embodiment of FIG. 2, the intermediate stations 24, 24' and the guide surfaces 25' have been eliminated and the single unloading station 27 being substituted for the loading station 26 in the embodiment of FIG. 2. The loading station 26 has been exchanged for the unloading station 27' of the embodiment of FIG. 2.

In the arrangement of FIG. 3, the open front end of the unloading carriage 25 at the unloading station 27 is disposed adjacent the conveyor path 17 so that empty cans 12 are conveyed by means of the chains 34 in groups of two onto the path 17 at the transit stations 23, 23'. Subsequently, the slider 13 is moved as in the embodiment of FIG. 1 both horizontally and rotatively to move empty cans 12 from the transit stations 23, 23' onto the filling stations 11, 11'. Similar to the embodiment of FIG. 1, the filled cans at the filling stations 11, 11' are moved to the right onto the transit stations 23, 23'.

Means are provided for moving the filled cans from the transit stations 23, 23' onto the carriage 25 at the loading station 26. More specifically, a pneumatic device 19 having a plunger 20 is actuated to move the plunger in the direction of the arrow P to move the filled cans at the transit stations 23, 23' into an intermediate position as identified by the filled cans 12' on the path 17. In the position shown for the filled cans 12' the cans 12' are disposed adjacent the open front end of the loading carriage 25. Another pneumatic device 19' having a plunger 20' in the form of a plate is positioned along the path 17 at the upper end as shown in FIG. 3 so that when the filled cans 12' arrive at the intermediate station, actuation of the pneumatic device 19' moves the plate 20' to the right, as viewed in FIG. 3, moving the filled cans 12' into the loading carriage 25 at the loading position 26.

The can changing device according to the invention allows for numerous modifications of the embodiments shown and described herein. A few preferred variants are described hereinafter. Obviously, numerous other variants which are not described, are also possible.

For example, even though this variant may be less advantageous on account of its complicated control system, in the course of each can changing operation, an empty can could be displaced from each carriage 25 at the unloading station 27, 27' onto the conveyor path and the plunger could each time have previously executed a maximum stroke or the empty cans could be removed from the respective carriages in phase opposed.

If the space allows, the unloading stations 27, 27' can also be disposed adjacent to the two sides of the machine 10 such that the empty cans 12 are pushed onto the conveyor path 17 from left to right as viewed according to FIG. 1. In place of the plungers 20 and conveying chains 34, other measures for pushing the cans onto the empty carriages 12 and the conveyor path 17 can also be provided. In some cases, it may also be expedient for the operation of pushing the cans onto the conveyor path and/or onto at least one carriage to be effected by suitably inclining the carriage at the unloading station to move cans 12 onto the conveyor path by means of gravity; in this case, suitable releasable barriers, for example, pivotable arms, can be provided to prevent cans 12 from being pushed onto the corresponding inclined path, as long as this is not to take place.

If the plungers 20 with their drive devices 19 are not satisfactory for reasons of space, two conveying chains can be provided for the conveyor path.

It is also possible in certain cases for the unloading stations to be located in the positions in which the drive devices 19 of the plungers 20 are located in FIG. 1; in the case of carriages containing two rows of cans, the cans can advantageously be pushed onto the conveyor path to form a single row by means of stationary guides or adjustable deflector surfaces.

It is possible to provide only one of the two unloading stations 27 or 27'. In this case, the two transit stations 23, 23' are arranged adjacent to one another and the empty cans are guided from them to the two spaced apart delivery stations 11, 11' by means of the slider 13 and by means of inclined guide surfaces. The carriage is thus unloaded as rapidly at the single unloading station as the carriage at the loading station.

If only one fiber lap is present, one of the two unloading stations 27, 27' can also be omitted. If the carriages are adapted to hold two rows of cans it may be advantageous not to arrange the two intermediate stations 24, 24' adjacent to one another but in series in the direction of the carriages 25 and to provide adjustable strips forming lateral guide surfaces for alternative adjustment of the intermediate stations in the direction of the other rows, i.e., the particular "strips" can either be directed toward one row of cans in the carriage or toward the other row such that the carriage can be fully loaded with filled cans at the loading station without having to move it at right angles.

If the spinning preparation machines have four fiber lap delivery stations, the above-described arrangement in which two fiber lap delivery stations are supplied with empty cans from the one unloading station can be duplicated, i.e., two unloading stations can be provided.

If, for reasons of space, it is not advisable for the two unloading stations to be arranged as a mirror image to one another, it is possible, for example, for one unloading station to be provided on the one longitudinal side of the conveyor path and the other unloading station on the other longitudinal side of the conveyor path, etc.

It is also possible to provide two loading stations for the conveyor path. For example, the two unloading stations 27, 27' could be coverted into loading stations and the loading station 26 could be changed into an unloading station; appropriate changes obviously being made to the conveying means displacing the filled and empty cans.

In an embodiment which is not represented, in place of the four conveying chains 34 represented in FIG. 1, four push rods for moving the empty cans from the carriage 25 onto the conveyor path 17 and which are displaceable in a reciprocating manner beneath the respective carriage, are provided for the unloading stations 27, 27'. These push rods bear pivotable, barb-type engaging means biased by spring means; one engaging means of each push rod engaging members located between the same and the conveyor path are pressed downwards by the cans located thereabove against the action of the spring means seeking to raise the same. It is thus sufficient for the stroke of the push rod to be only slightly larger than the diameter of the can such that after each double stroke of the push rod, another engaging means moves behind the last can in the row and all the empty cans in each rows are thus conveyed step-by-step to the conveyor path.

What is claimed and desired to be secured by Letters Patent of the United States is:

1. A can changing apparatus for a silver collecting machine wherein the operation of loading and unloading stations is exchangeable comprising:

means defining a filling station for supporting silver cans in a position to be filled;

a straight conveyor path slightly wider than the silver can diameter extending parallel to said filling station;

means defining an intermediate station for temporary storage of full cans on the other side of said path from said filling station as they are removed from the conveyor path;

first conveyor means for advancing empty cans along said path and into position directly in front of said filling station;

full-can receiving cart means positioned adjacent and on the opposite side of said intermediate station from said path;

rotatable second conveyor means at said filling station for moving filled cans first from said filling station to said path, next through said path to said intermediate station and then onto said full-can receiving cart means, and for moving empty cans from said path to said filling station;

third conveyor means associated with said empty-can cart means for transferring empty cans from said empty-can cart means to said straight conveyor path, all of said conveyor means operated in timed relation to each other.

2. A can changing apparatus for a silver collecting machine as claimed in claim 1 wherein said second conveyor means is arranged to be rotated about a horizontal axis subsequent to moving full cans from said filling station so that said second conveyor means can be returned to an inoperative position preparatory to moving more empty cans toward said filling station.

3. Apparatus as defined by claim 1 in which said second conveyor means includes a reciprocable cage for moving cans in either direction normal to said straight conveyor path.

4. A can changing apparatus for a silver collecting machine wherein the operation of loading and unloading stations is exchangeable comprising:

means defining a filling station for supporting a pair of silver cans in a position to be filled;

a straight conveyor path slightly wider than the silver can diameter extending parallel to and outwardly from opposite ends of said filling station;

means defining an intermediate station for temporary storage of full cans on the other side of said path from said filling station as they are removed from the conveyor path;

first conveyor means at opposite ends of said path for advancing empty cans along said path toward each other and into position directly in front of said filling station;

full-can receiving cart means positioned adjacent and on the opposite side of said intermediate station from said path, said full-can receiving cart means being dimensioned to receive two rows of cans thereon;

rotatable second conveyor means at said filling station to said path, next through said path to said intermediate station and then onto said full-can receiving cart means, and for moving empty cans from said path to said filling station;

a pair of empty-can cart means positioned adjacent said path and spaced along said path on opposite sides of said full-can receiving cart means; and third and fourth conveyor means one associated with each of said empty-can car means respectively for transferring pairs of empty cans from said pair of empty-can cart means to said straight conveyor path, all of said conveyor means operating in timed relation to each other.

5. Apparatus as defined by claim 4 in which said second conveyor means includes a reciprocable cage dimensioned for moving pairs of cans in either direction normal to said conveyor path.

6. A can changing apparatus for a silver collecting machine as claimed in claim 4 wherein said second conveyor means is arranged to be rotated about a horizontal axis subsequent to moving full cans from said filling station so that said second conveyor means can be returned to an inoperative position preparatory to moving more empty cans toward said filling station.

7. A can changing apparatus for a silver collecting machine wherein the operation of loading and unloading stations is exchangeable comprising:

means defining a filling station for supporting sliver cans in a position to be filled;

a straight conveyor path slightly wider than the silver can diameter extending parallel to said filling stations and conveyor path having a portion adjacent said filling station defining a transit station for alternate temporary storage of empty and filled cans;

full can receiving cart means positioned adjacent said path on the opposite side of said path from said filling station;

at least one empty-can cart means, positioned adjacent said path on the side of said path opposite said filling station and spaced along said path from said full-can receiving cart means;

rotatable conveyor means at said filling station for moving filled cans first from said filling station to said transit station on said path;

means for moving empty cans from said empty-can cart means to said transit station; and means for moving full cans from said transit station to said full-can receiving cart means.

8. A can changing apparatus in accordance with claim 7 wherein said empty-can cart means is disposed directly opposite said filling station.

9. A can changing apparatus in accordance with claim 7 wherein said full-can cart means is disposed directly opposite said filling station.

10. A can changing apparatus in accordance with claim 7 wherein said means for moving full cans from said transit station to said full-can receiving cart means comprises said rotatable conveyor means.

11. A can changing apparatus in accordance with claim 7 wherein said means for moving full cans from said transit station to said full-can receiving cart means comprises reciprocally movable drive means.

12. A can changing apparatus in accordance with claim 11 wherein said reciprocally movable drive means include a first drive device having a plunger reciprocally movable in a direction corresponding to said conveyor path and a second drive device having a plunger reciprocally movable in a direction transverse to said conveyor path.

13. A can changing apparatus in accordance with claim 9 including a pair of empty-can cart means each disposed along said conveyor path on opposite side of said full-can receiving cart means.

* * * * *